US005408794A

United States Patent [19]

Lyng

[11] Patent Number: 5,408,794

[45] Date of Patent: Apr. 25, 1995

[54] SANDING ELEMENT AND APPARATUS

[76] Inventor: James W. Lyng, 2350 SW. 42nd Ter., Fort Lauderdale, Fla. 33317

[21] Appl. No.: 944,668

[22] Filed: Sep. 14, 1992

Related U.S. Application Data

[63] Continuation-in-part of Ser. No. 702,397, May 20, 1991, abandoned.

[51] Int. Cl.[6] ..... B24B 23/02

[52] U.S. Cl. ..... 451/358; 451/490; 451/526

[58] Field of Search ..... 51/170 R, 170 PT, 168, 51/358, 394, 400

[56] References Cited

U.S. PATENT DOCUMENTS

| | | | |
|---|---|---|---|
| 1,023,406 | 4/1912 | Ackerman | 51/170 PT |
| 1,321,847 | 11/1919 | Pond | 51/170 PT |
| 1,480,263 | 1/1924 | Hoffman | 51/170 PT |
| 1,739,653 | 12/1929 | Sassano | 51/170 PT |
| 1,900,331 | 3/1933 | Clarke | 51/170 PT |
| 2,853,838 | 9/1958 | Richards | 51/170 PT |
| 2,925,644 | 2/1960 | Barggren | 51/170 PT |
| 3,793,782 | 2/1974 | Bowling | 51/170 PT |
| 4,993,192 | 2/1991 | Demetrius | 51/170 PT |

*Primary Examiner*—Jack W. Lavinder

*Attorney, Agent, or Firm*—Oltman and Flynn

[57] ABSTRACT

An apparatus for sanding a work piece includes a motor, a motor housing, an essentially cylindrical sanding element assembly including a sanding element, a tubular sanding element assembly first support member extending from the motor housing to the sanding element assembly, and a drive train extending from the motor through the first support member to the sanding element assembly. The motor housing is preferably cylindrical and has a longitudinal axis, and the first support member extends essentially perpendicular to the housing longitudinal axis, and the cylindrical sanding element assembly also has a longitudinal axis which is essentially parallel to the housing longitudinal axis. The sanding element assembly and the housing each preferably have two ends, and the first support member is preferably joined to one end of the housing and to one end of the sanding element assembly, and additionally includes a second support member joined to the end of the housing and extending to engage the other end of the sanding element assembly. The second support member is preferably removable from the sanding element assembly so that the sanding element can be removed and optionally reversed when the sanding element becomes worn.

21 Claims, 20 Drawing Sheets

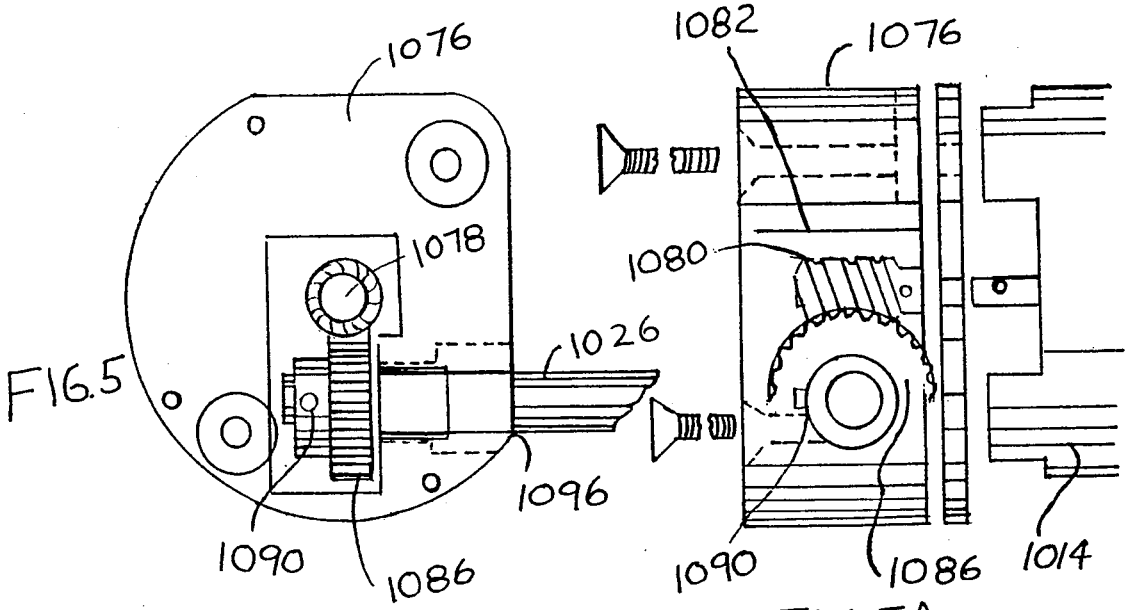
FIG.5
FIG.5A
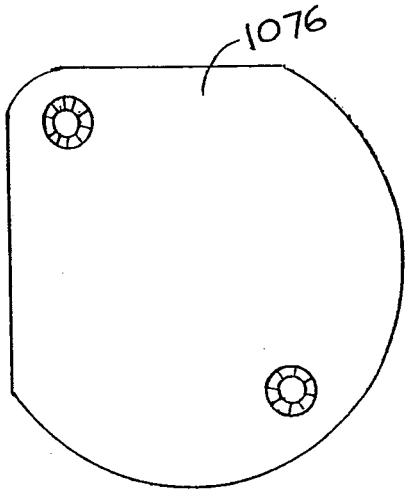
FIG.5B
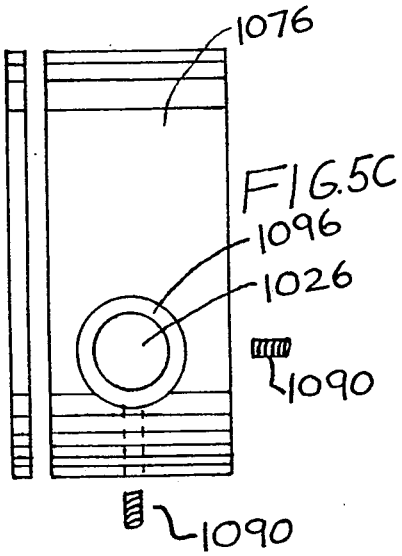
FIG.5C
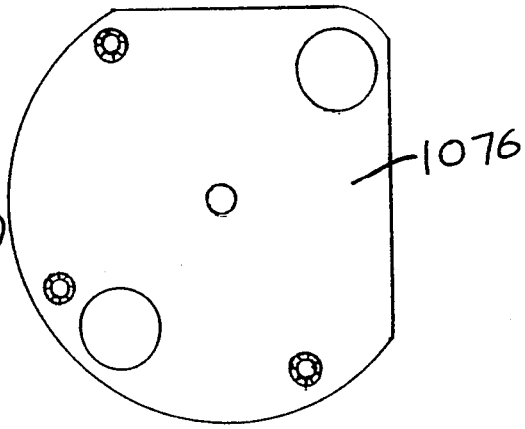
FIG.5D

FIG. 6A
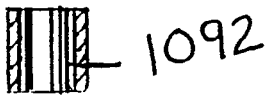
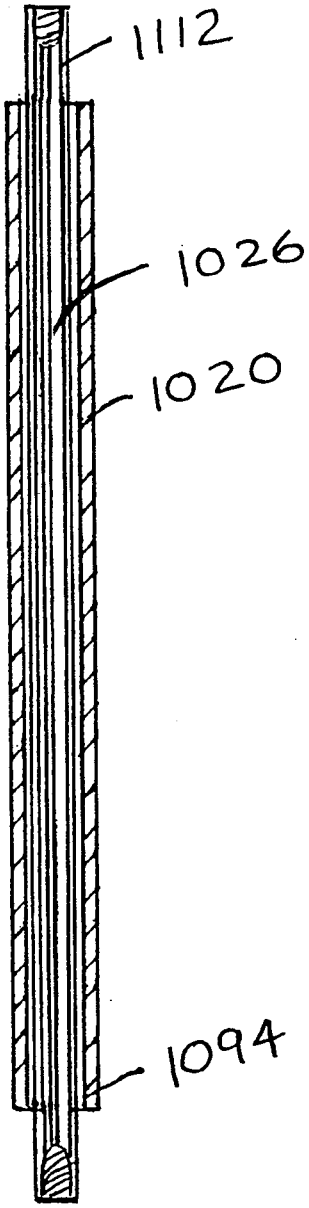
FIG. 6
FIG. 6B
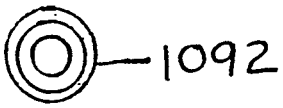
FIG. 6C
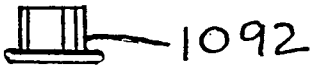

FIG. 7
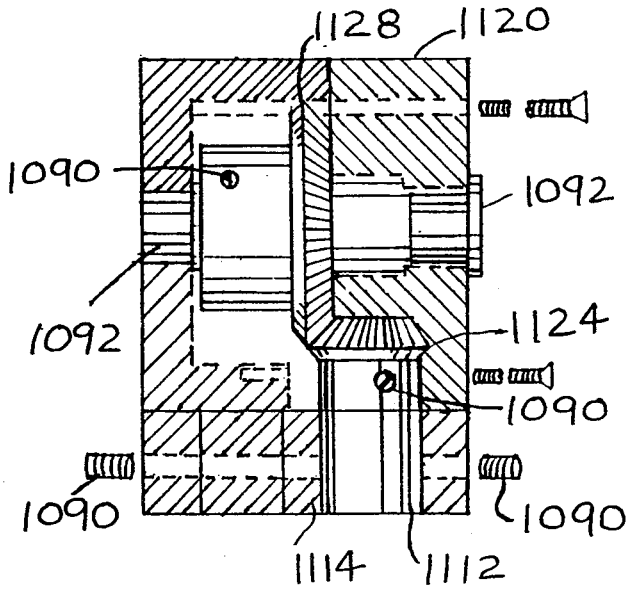
FIG. 7A
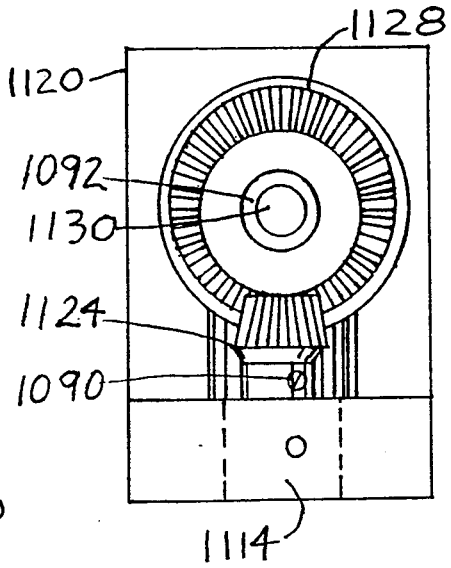
FIG. 7B
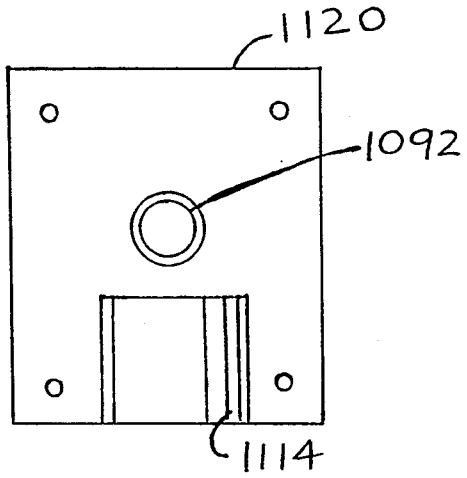
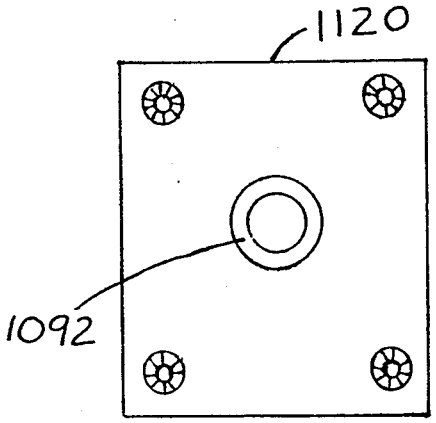
FIG. 7C
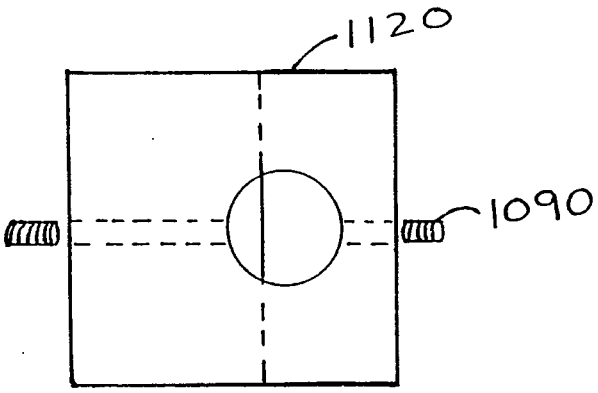
FIG. 7D FIG. 10
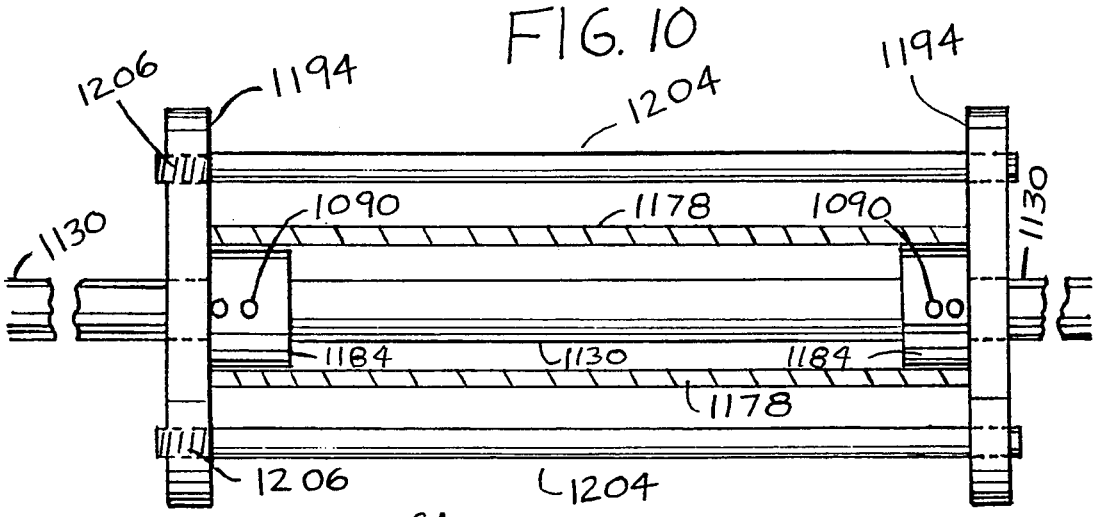
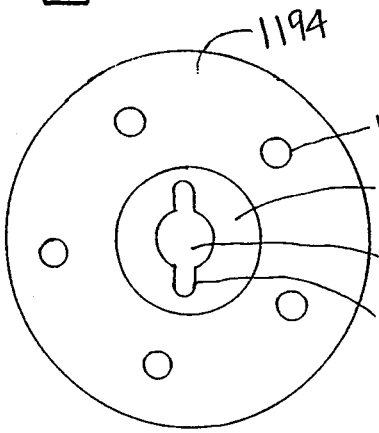
FIG. 10A
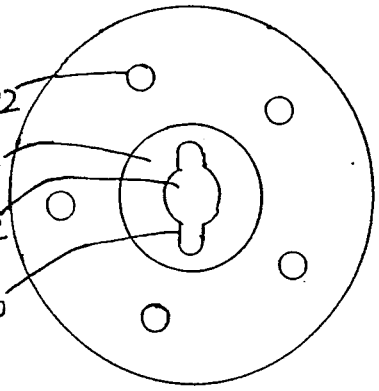
FIG. 10C
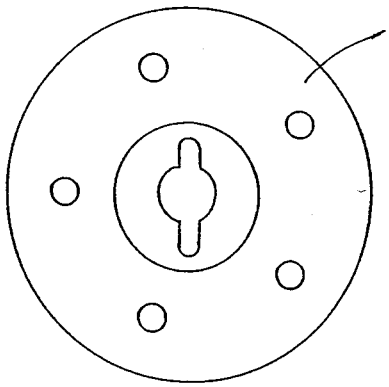
FIG. 10B
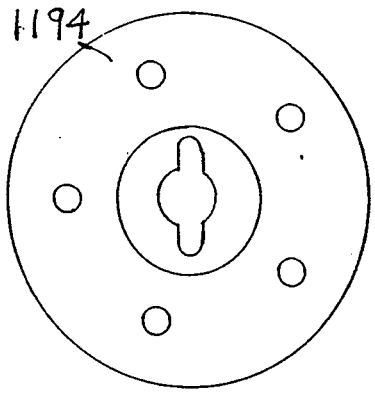
FIG. 10D FIG. 13
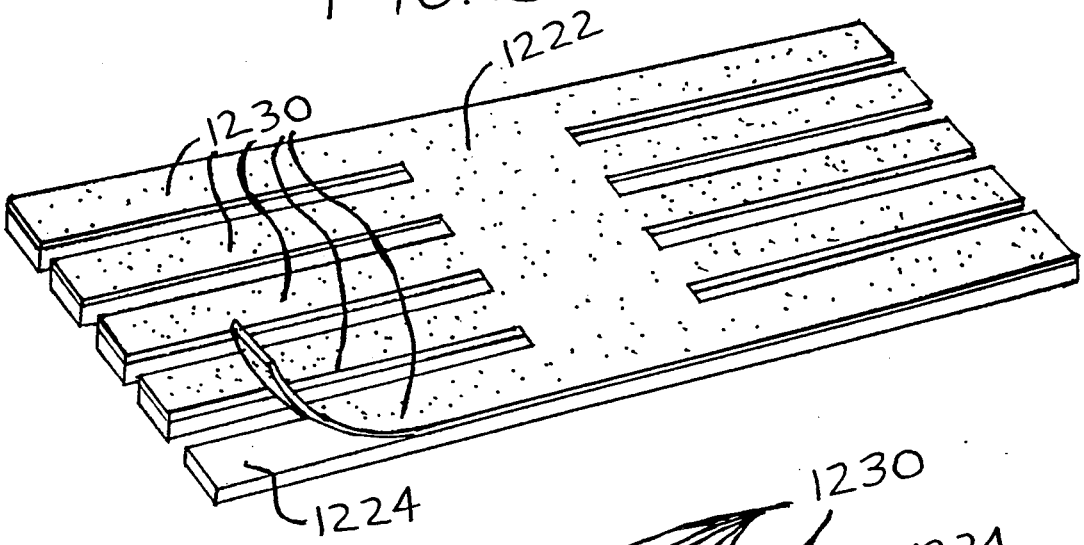
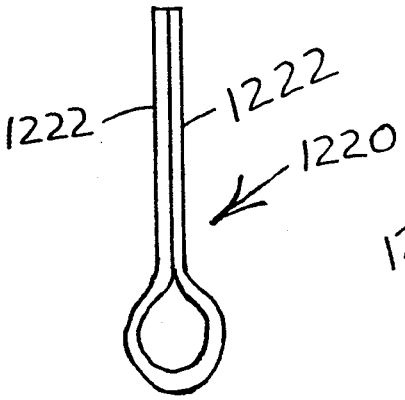
FIG. 13B
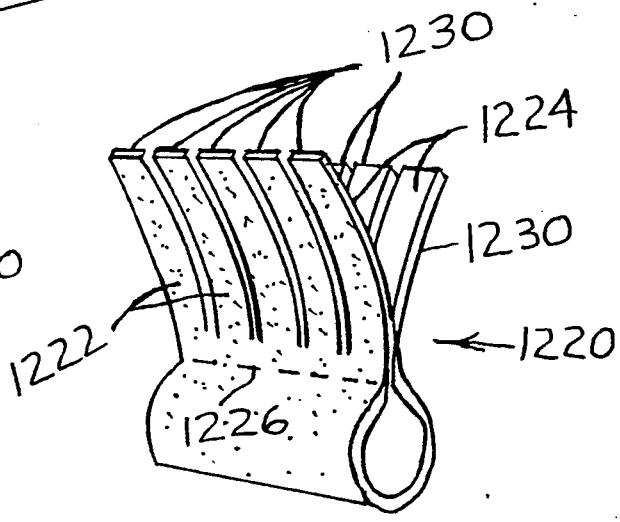
FIG. 13A FIG. 14
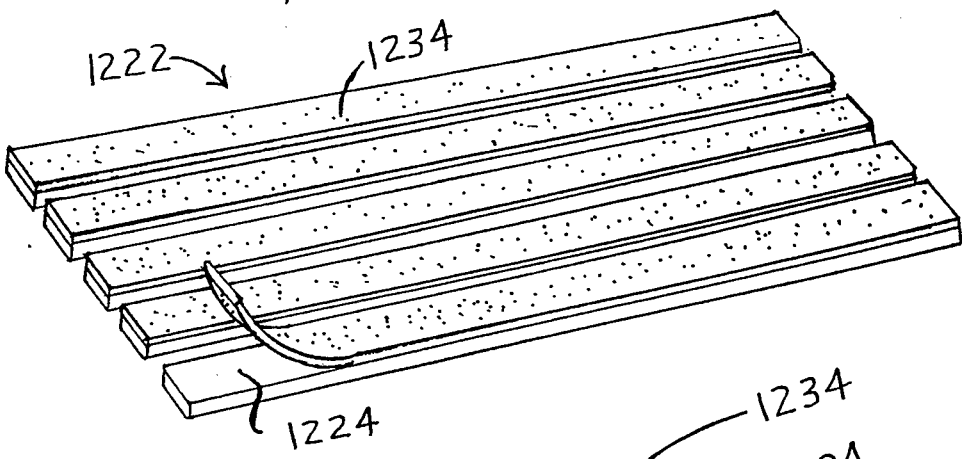
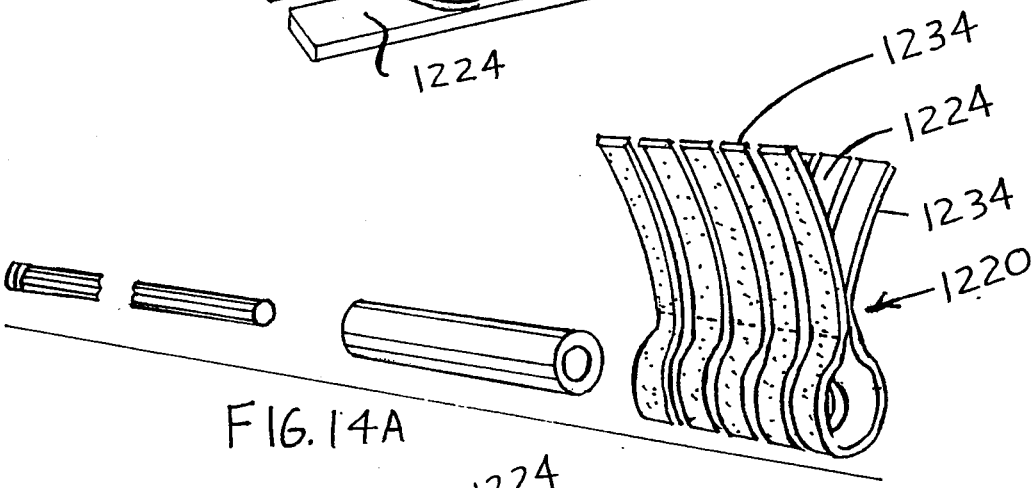
FIG. 14A
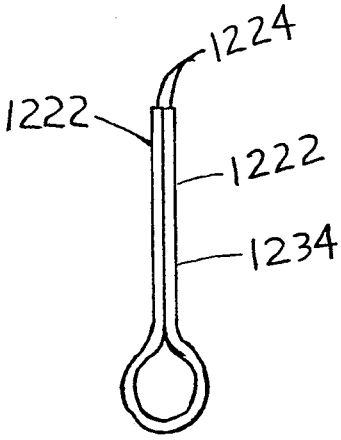
FIG. 14B FIG. 15
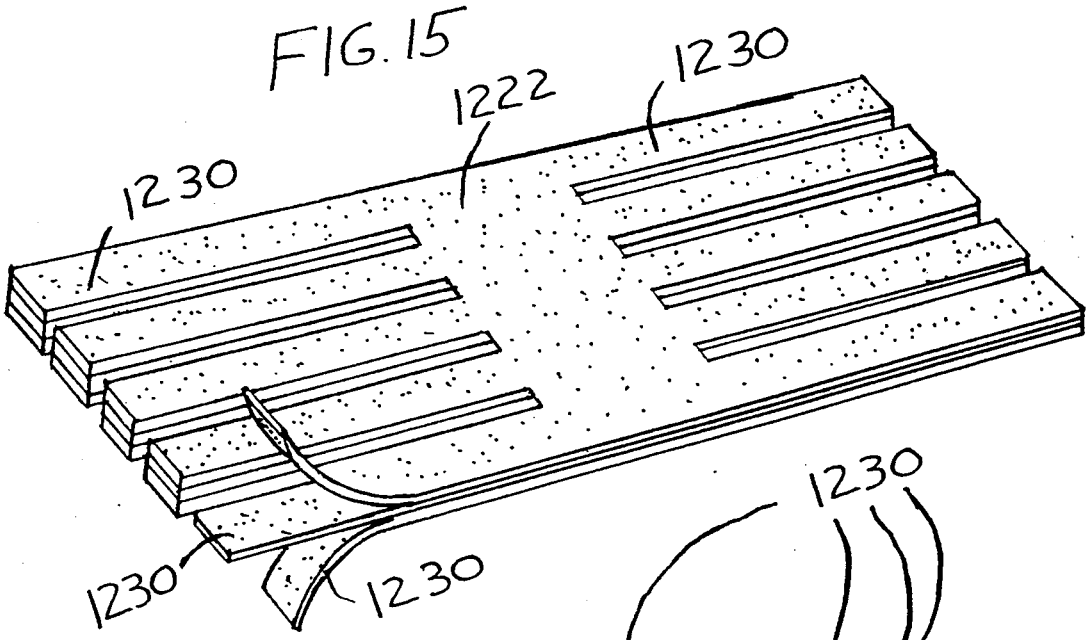
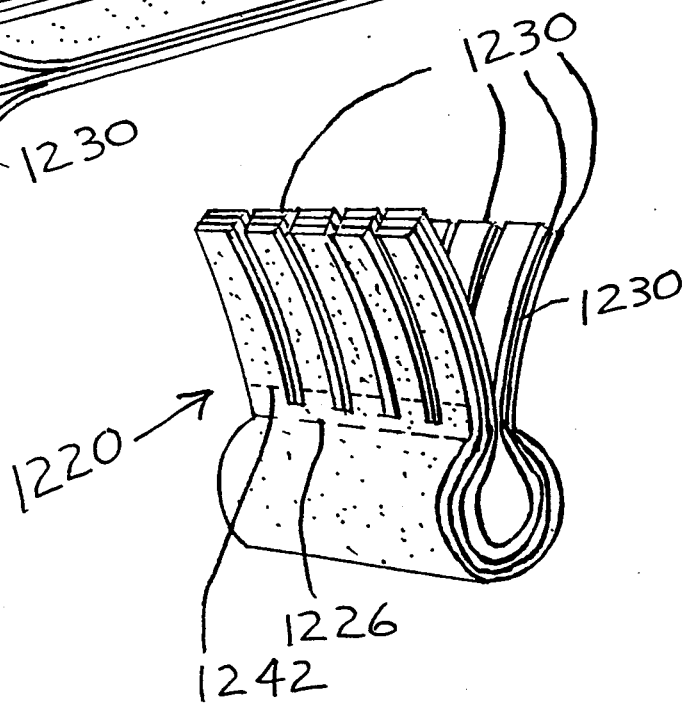
FIG. 15A FIG. 17
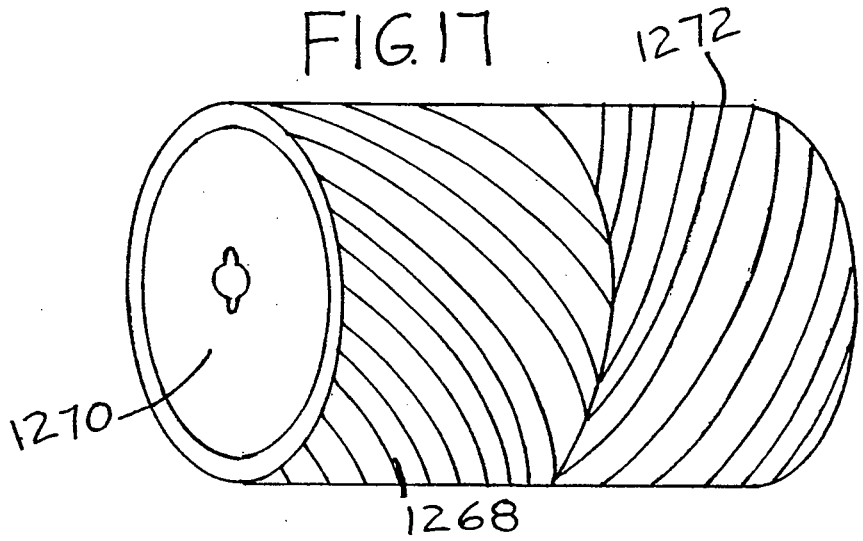
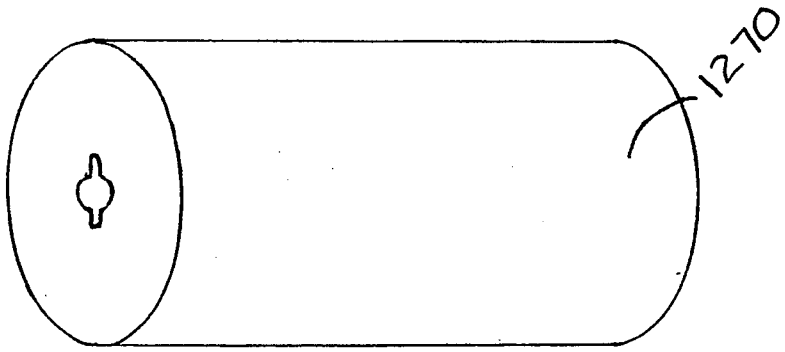
FIG. 17A
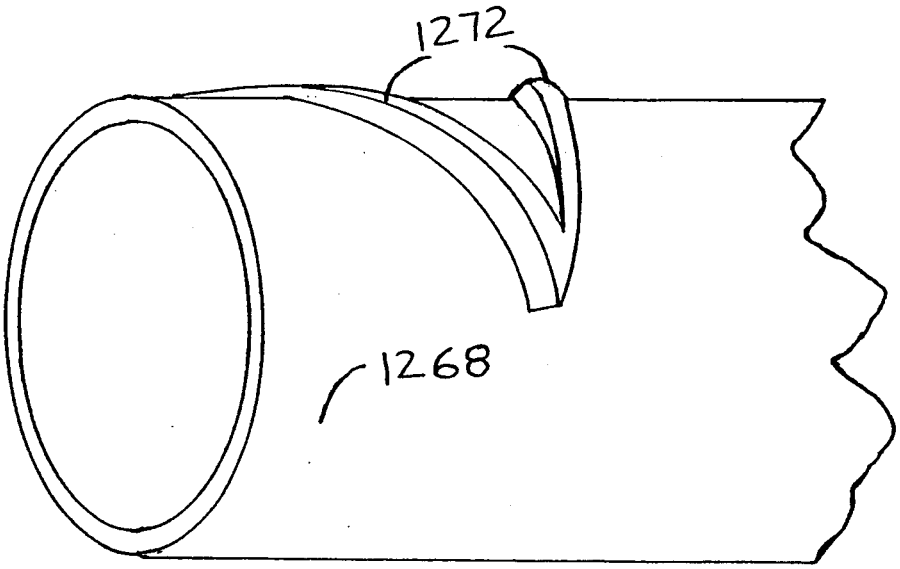
FIG. 17B

SANDING ELEMENT AND APPARATUS

This application is a continuation-in-part of application Ser. No. 07/702,397 filed on May 20, 1991, now abandoned. Applicant has filed Disclosure Document No. 251511 on Apr. 25, 1990.

BACKGROUND OF THE INVENTION

1. Field of the Invention

The present invention relates generally to the field of automatic sanding devices, and more specifically to an electric sanding apparatus having multiple abrasive flaps.

2. Description of the Prior Art

There has long been a need for a portable, lightweight, automatic sanding tool to replace manual sanding of doors, jambs, casings, louvered bifolds, shutters and the like, having unfinished surfaces which need sanding after priming or sealing, or having previously painted surfaces which need sanding before application of finish coats of paint. Furthermore, there has long been a need for a sanding element which can uniformly sand uneven walls and other surfaces and sand between projections on surfaces.

A variety of automatic sanding devices and elements is found in the prior art. One such device is taught in Taafe, U.S. Pat. No. 3,498,009, issued Mar. 3, 1970. Taafe discloses a cylindrical sanding element and element rotating device, resembling a paper towel rack with a motor and handle on it. A problem with Taafe is that its broad uniform sanding element would only make contact with the high points of an uneven surface. Recessed areas would thus remain unsanded. Also, the reach of Taafe is only a few inches beyond its handle, making Taafe unsuited for reaching high or otherwise hard to reach areas.

A finishing wheel or element is disclosed in Schaffner, U.S. Pat. No. 3,706,167, issued Dec. 19, 1972. Schaffner comprises an annulus of flaps bonded near the center to form a substantially solid hub. This hub is mounted on any of several rotary tools. Narrow Schaffner flaps would effectively sand between projections and within valleys of surface undulations. Yet they would also cover only a small surface area at a given moment, making the sanding job very time-consuming. On the other hand, wide Schaffner flaps would be unable to reach between surface peaks, as in Taafe. Therefore, Schaffner is either excessively slow or simply unsuited to sanding uneven surfaces.

Hasegawa, U.S. Pat. No. 3,795,498, issued Mar. 5, 1974, teaches a method of making a sanding wheel from a stack of abrasive, flexible leaves. Grooves are cut in the edges of the stack. An adhesive-covered string is inserted into these grooves and the leaves are then radially wrapped around a hub. Hasegawa is simply the wide flap version of Schaffner, and is thus unsuited to evenly sanding undulating surfaces.

Ali, U.S. Pat. No. 3,872,630, issued Mar. 25, 1975, is another variation of radially-mounted flaps on a hub. Ali provides a means of inserting clusters of flaps, fastened together face-to-face at one end, into a specially slotted hub portion. The problems of Ali when applied to undulating surfaces are identical to those of Schaffner and Hasegawa. The same is true of Wilson, U.S. Pat. No. 4,365,448, issued Dec. 28, 1982 and of Block, U.S. Pat. No. 4,872,292, issued Oct. 10, 1989.

It is thus an object of the present invention to provide a sanding element which can evenly and rapidly sand undulating surfaces and surfaces having projecting portions.

It is another object of the present invention to provide a sanding apparatus which is light and easy to handle.

It is still another object of the present invention to provide a sanding apparatus and sanding element to the skilled tradesman as well as to the ordinary do-it-yourselfer, which effectively sands planar as well as irregular surfaces quickly, efficiently, at low cost and with minimal labor.

It is finally an object of the present invention to provide such a sanding apparatus and sanding element which are relatively inexpensive, simple in construction and sufficiently compact to permit easy transport and storage.

SUMMARY OF THE INVENTION

The present invention accomplishes the above-stated objectives as well as others, as may be determined by a fair reading and interpretation of the entire specification.

An apparatus for sanding a work piece is provided which includes a motor, a motor housing, an essentially cylindrical sanding element assembly including a sanding element, a tubular sanding element assembly first support member extending from the motor housing to the sanding element assembly, and a drive train extending from the motor through the first support member to the sanding element assembly. The motor housing is preferably cylindrical and has a longitudinal axis, and the first support member extends essentially perpendicular to the housing longitudinal axis, and the cylindrical sanding element assembly also has a longitudinal axis which is essentially parallel to the housing longitudinal axis. The sanding element assembly and the housing each preferably have two ends, and the first support member is preferably joined to one end of the housing and to one end of the sanding element assembly, and additionally includes a second support member joined to the end of the housing and extending to engage the other end of the sanding element assembly. The second support member is preferably removable from the sanding element assembly so that the sanding element can be removed when the sanding element becomes worn.

BRIEF DESCRIPTION OF THE DRAWINGS

Various other objects, advantages, and features of the invention will become apparent to those skilled in the art from the following discussion taken in conjunction with the following drawings, in which:

FIGS. 5, 5*a* and 5*b* are projection views of the interior face and, top, respectively, of the housing end block showing the motor worm gear and drive shaft gear, and FIGS. 5c and 5d are outer face and side views, respectively of the opposing end block.

FIG. 6 is a cross-sectional side view of the first support member and drive shaft inside, FIG. 6a is a section of a bushing and FIGS. 6b and 6c are top and side views, respectively, of a bushing for either end of the drive shaft.

FIGS. 7–7d are a cross-sectional side view, a cross-section of a projection of the side view, another cross-section taken along line a—a in FIG. 7, a projection view of FIG. 7 and a bottom view, of the mounting block at the end of the first support member, respectively.

FIG. 10, and FIGS. 10a and 10b, are a side view of the inventive sanding element assembly, and views of the internal and external faces of the left disk member, respectively, and FIGS. 10c and 10d are views of the internal and external faces of the right disk, respectively.

FIGS. 13, 13a and 13b are views as in FIG. 12, except that the sheet is cut to form strips.

FIGS. 14–14b are views as in FIG. 12, except that the sheet is cut into several separate and elongate sheets, and a buffer tube is illustrated in FIG. 14a.

FIGS. 15 and 15a are views as in FIGS. 12 and 12a, except that multiple layers of sanding paper are provided, so that a worn layer can be torn away to reveal a fresh sand paper surface.

FIGS. 17–17b are perspective views of the complete ridged drum assembly for scraping paint, the drum alone, and the removable ridged tube portion, respectively.

DESCRIPTION OF THE PREFERRED EMBODIMENTS

Figure 1:
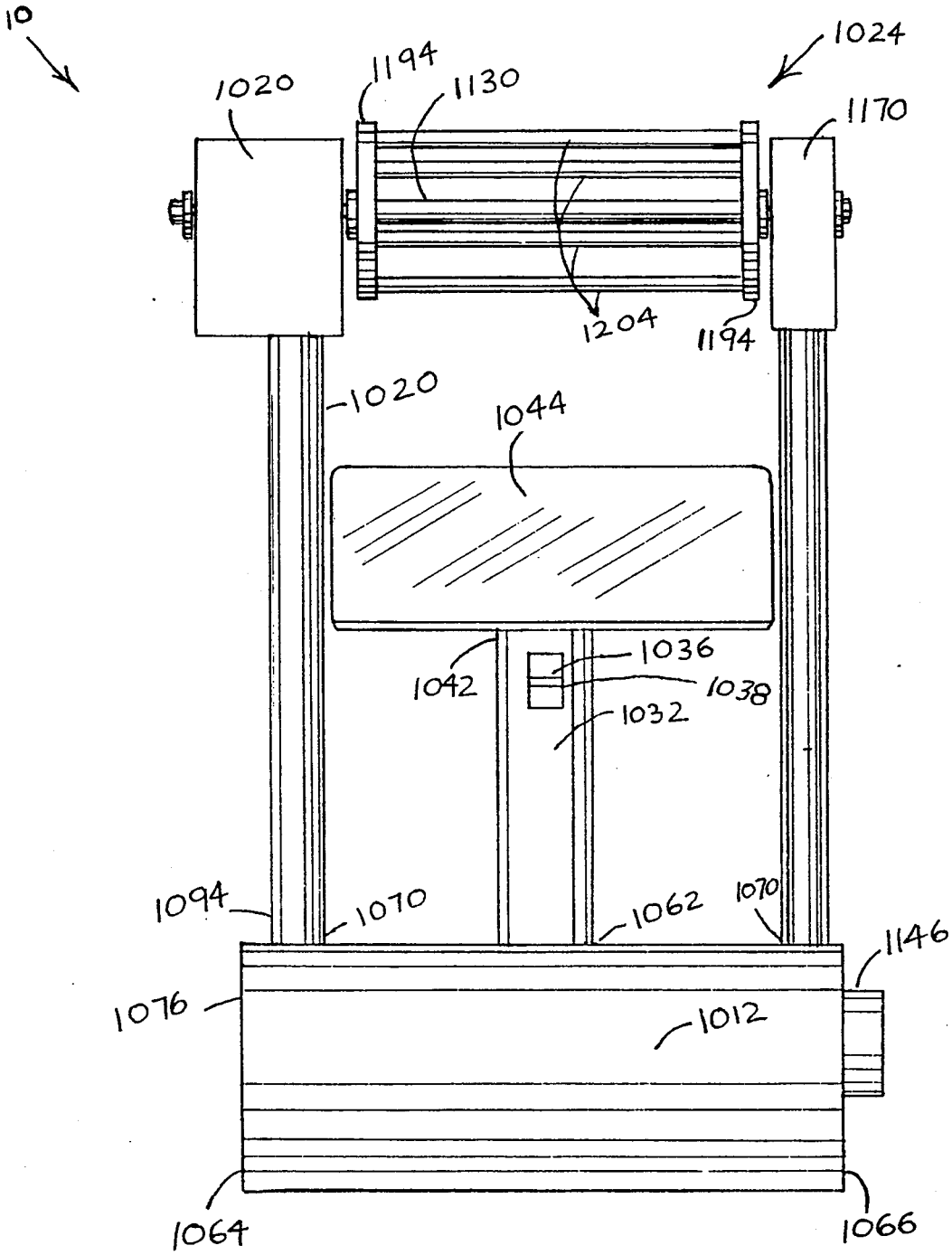
FIG. 1 is a front view of one version of the preferred embodiment of the inventive apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 3:
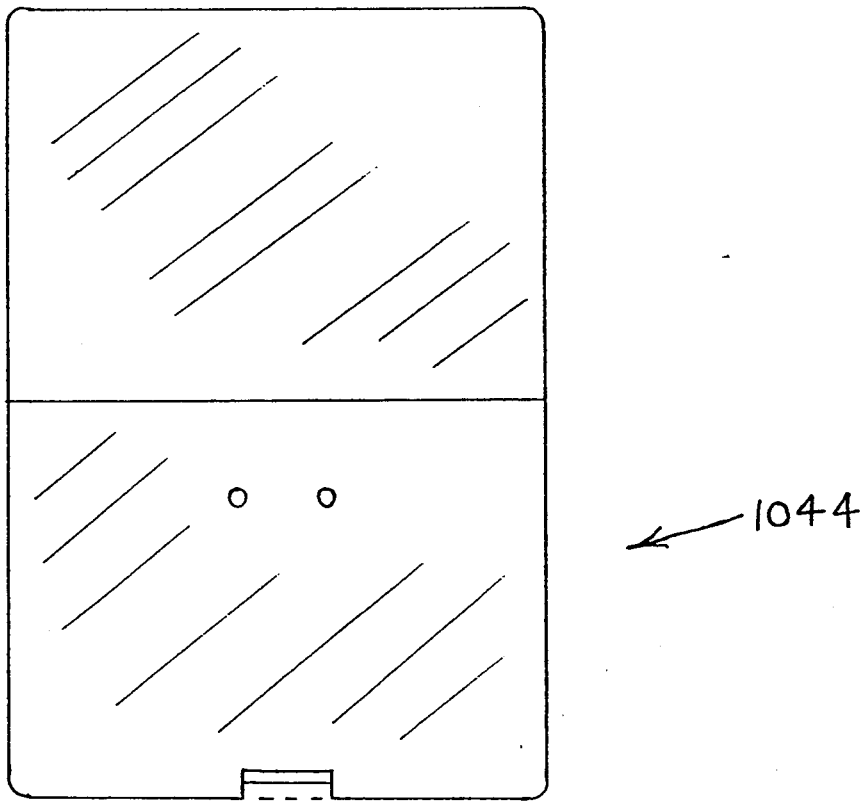
FIGS. 3 and 3*a* are top and edge views respectively of the protective plate mounted on the handle.
Figure 3A:
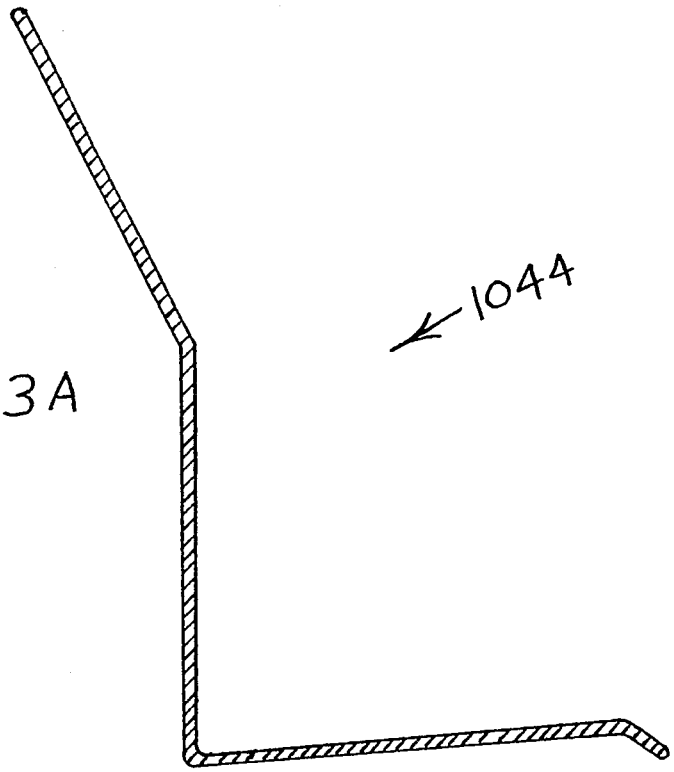
Figure 2:
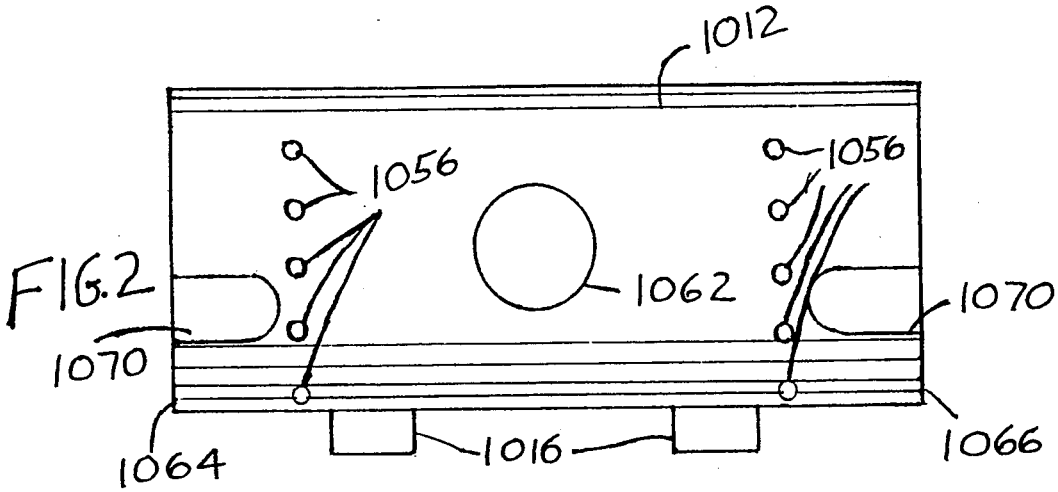
FIG. 2 is a top view of the motor housing only.
Figures 4, 4A, 4B:
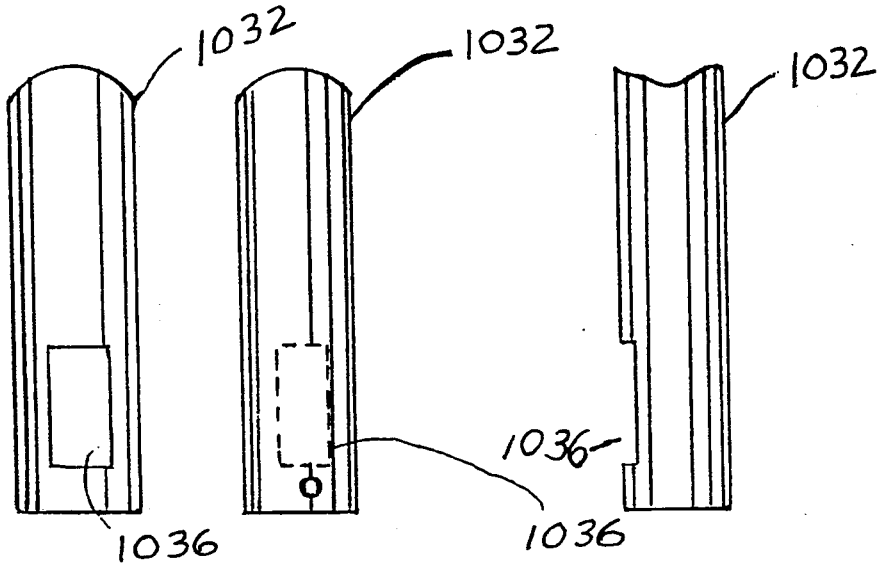
FIG. 4 is a top and side projection view of the plug member fitted into the free end of the tubular handle.
FIGS. 4*a*, 4*b*, 4*c* and 4*d* are a front, rear and side view, respectively of the end of the handle showing the rectangular hole through which the switch button protrudes.
Figures 4C, 4D:
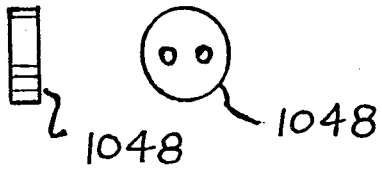

Referring now in general to the various FIGURES of the drawings, a sanding apparatus 10 is disclosed comprising an essentially rectangular configuration. See FIG. 1. A cylindrical housing 1012 for an electric motor 1014 has a longitudinal axis L. Two disk-shaped rubber feet 1016 are optionally provided on housing 1012 for setting down apparatus 10. See FIG. 2. Two parallel support members 1020 and 1022 project from housing 1012, one at each end of housing 1012, perpendicular to axis L. Between members 1020 and 1022 an essentially cylindrical sanding element assembly 1024 is mounted to rotate about its longitudinal axis M. One member 1020 is a hollow tube containing a drive shaft 1026 for transmitting torque from motor 1014 to assembly 1024. A tubular handle 1032 projects from housing 1012 midway between and parallel to members 1020 and 1022. Handle 1032 is about half the length of members 1020 and 1022, and contains an electric switch 1036 for controlling the flow of electric current from an outlet cord to motor 1014. The switch button 1038 is located near the free end 1042 of handle 1032, and a shield or safety plate 1044 is perpendicularly secured to free end 1042. Safety plate 1044 made of LEXAN TM plastic preferably has a bend to extend partly around assembly 1024, and is secured to a plug member 1048 made of DELRIN TM plastic, fit into free end 1042 of handle 1032. See FIGS. 3–3a and 4.

To use this embodiment of apparatus 10, the user grips handle 1032 so that with his thumb is on variable speed switch button 1038. The user then turns on motor 1014 with his thumb, then orients and presses assembly 1024 against the work piece to be sanded.

Housing 1012 is preferably a PVC tube perforated by several heat vents 1056. See FIG. 2. A handle receiving hole 1062 is provided midway between housing ends 1064 and 1066, and a support member receiving slot 1070 is provided at each end 1064 and 1066.

Motor 1014 is fastened to a face 1072 of a PVC housing end block 1076. See FIGS. 5–5*d*. The motor shaft 1078 is fitted with a worm gear 1080 which extends perpendicularly into a bore 1082 in face 1072. A first end 1094 of tubular member 1020 is fitted into a hole 1096 in end block 1076 around drive shaft 1026. Worm gear 1080 engages a drive gear 1086 on a first end 1088 of drive shaft 1026. Drive gear 1086 is secured to drive shaft 1026 with a set screw 1090.

Drive shaft 1026 rides in a flanged bushing 1092, preferably an oil impregnated brass type, fitted into each end of tubular member 1020. See FIGS. 6–6*b*. The second end 1112 of drive shaft 1026 fits into a hole 1114 in a hollow PVC mounting block 1120, and is secured with set screws 1090. Drive shaft 1026 projects into block 1120 and a bevel gear 1124 is fit and secured over drive shaft 1026 with a set screw 1090. See FIGS. 7–7*d*. Bevel gear 1024 engages another bevel gear 1128 which is in turn secured with a set screw 1090 to an assembly shaft 1130. Shaft 1130 is perpendicular to drive shaft 1026. Assembly shaft 1130 rides in a bushing 1092, of the type described above, in block 1120.

Figure 8:
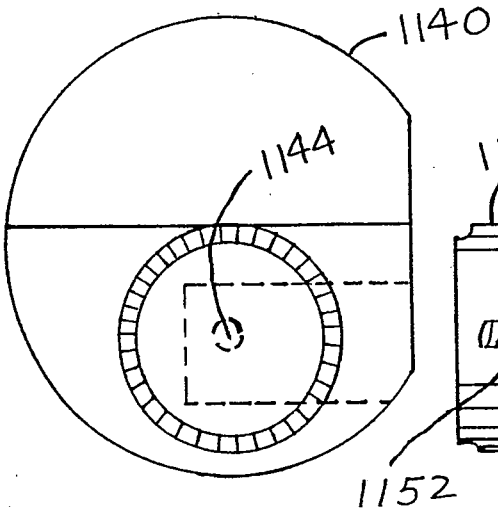
FIGS. 8 and 8a are an end view and an exploded side view of the housing end block connected to the second support member, showing the break-away section, the section mounting bolt, and the section securing knob.
Figure 8A:
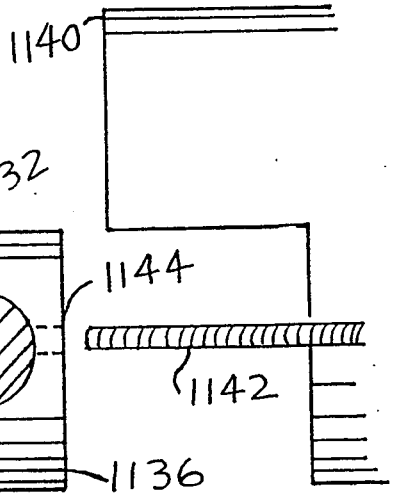
Figure 9:
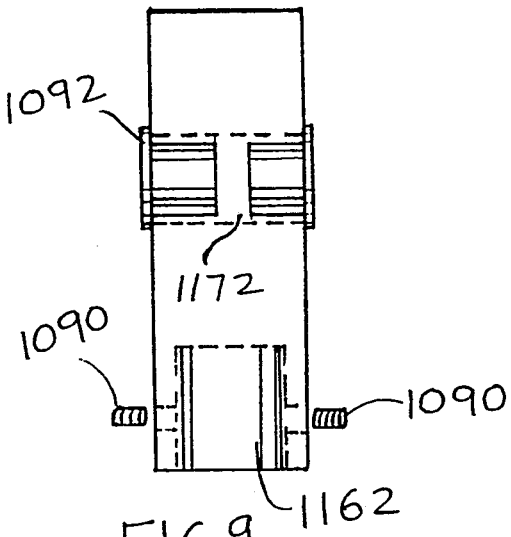
FIG. 9, and FIGS. 9a and 9b, are a cross-sectional side view and two projections of this view, respectively, of the mounting block at the end of the second support member. The member receiving hold and set screws, and assembly shaft receiving bore and bushings at each end can be seen.
Figure 9A:
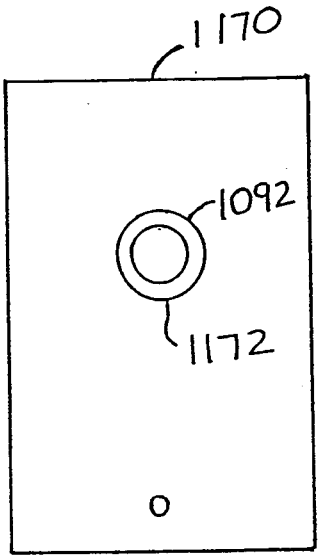
Figure 9B:
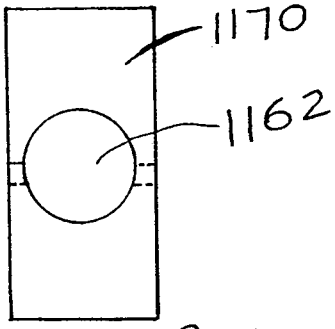

Member 1022 is designed to easily disconnect from apparatus 10 to free assembly 1024 for removal and replacement. Member 1022 fits into a hole 1132 in a removable section 1136 of the second end block 1140, and is secured with set screws 1090. See FIG. 8. A section mounting bolt 1142 is secured in second end block 1140 and projects loosely through a hole 1144 in section 1136. A removable securing knob 1146 has a threaded bore 1152 which engages the end of mounting bolt 1142 to fasten section 1136 in place. Member 1022 may be a solid shaft or tubular, and its second end 1160 fits into a hole 1162 in a mounting block 1170, where it is secured by set screws 1090. An assembly shaft bore 1172 is provided in mounting block 1170 perpendicular to member 1022, and a bushing 1092 is fit into each end of bore 1172. See FIGS. 9–9*b*. Assembly shaft 1130 fits into and rides within assembly shaft bore 1172. Thus, to remove member 1022, one simply unscrews knob 1146 and pulls member 1022, section 1136 and block 1170 off assembly 10.

Figure 11:
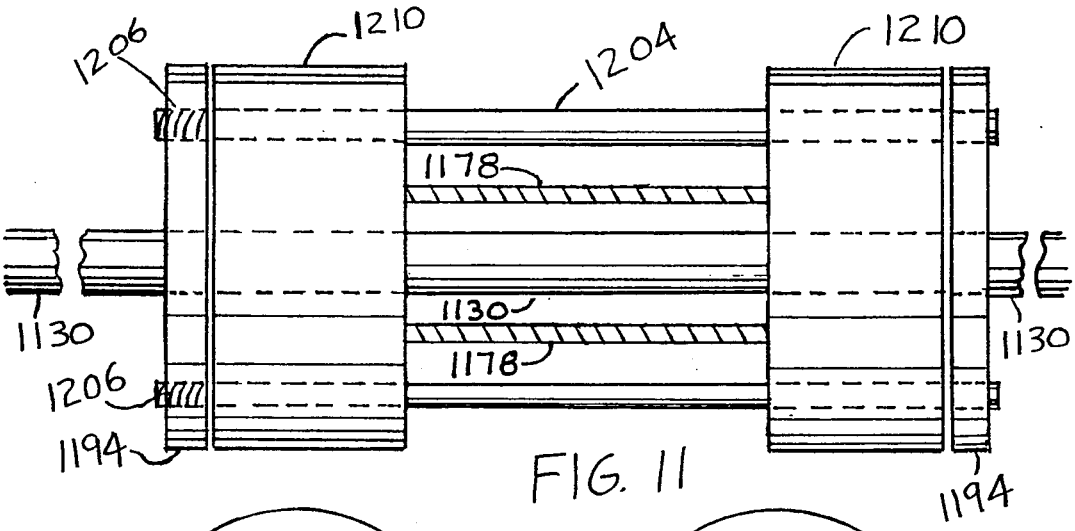
FIG. 11 is a side view of the inventive sanding element assembly.
Figure 11A:
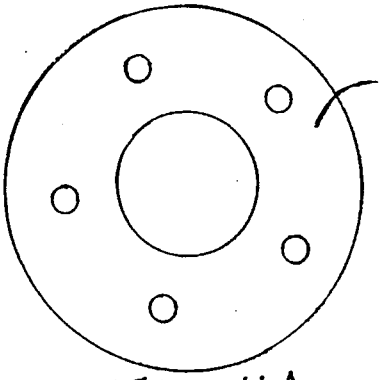
FIGS. 11a and 11b are views of the interior and exterior faces of the left cylindrical spacer, respectively.
Figure 11C:
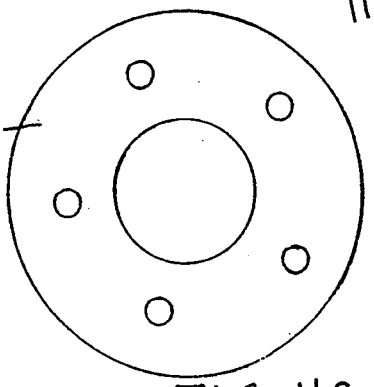
FIGS. 11c and 11d are the interior and exterior faces of the right cylindrical spacer, respectively.
Figure 11B:
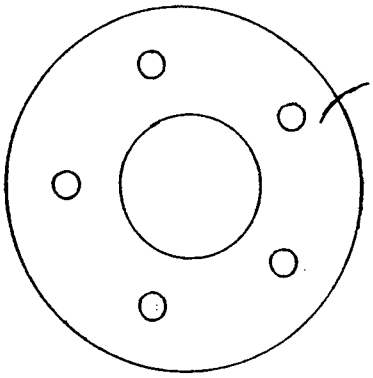
Figure 11D:
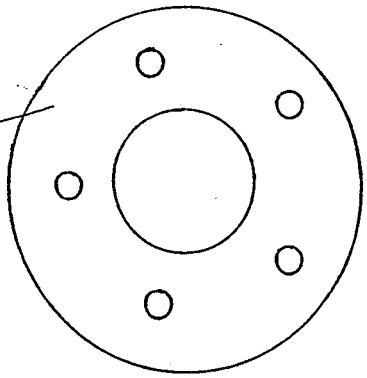

Assembly 1024 can take several forms, each specially suited to meet particular job requirements, and is designed to slide on and off assembly shaft 1130. Assembly 1024 is essentially cylindrical, and can be used on all embodiments of apparatus 10. A metal hub member 1180 is provided at each end, and each has a central hole 1182 for receiving shaft 1130, and a flange 1184 around hole 1182. See FIGS. 10–10*d*. A PVC tube 1178 fits over each flange 1184 and extends between hub members 1180. Each hub member 1180 contains a diametrically oriented slot 1186 for receiving a locking pin 1192 extending out of shaft 1130. A PVC disk member 1194 extends around the periphery of each hub member 1180. Several disk ports 1202 are provided for receiving sanding element rods 1204. Disk ports 1202 are radially equidistant from the center of the given hub member 1180 and spaced apart equal arc lengths. Element rods 1204 are each threaded at one end 1206 and screwed into internal threads in disk ports 1202 in one disk member 1194. The other disk ports 1202 just slide over the other ends of element rods 1204. Spacer cylinders 1210, each having a central hole and rod ports for fitting over PVC tube 1178 and element rods 1204, are optionally provided to center sanding elements 1220 having narrower widths. See FIGS. 11–11*d*. Sanding elements 1220 preferably have abrasive material on two sides. When one side becomes worn, assembly 1024 can be removed and reversed to expose the other side of elements 1220. This reversal of assembly 1024 can be done on all embodiments.

Figures 12, 12A, 12B:
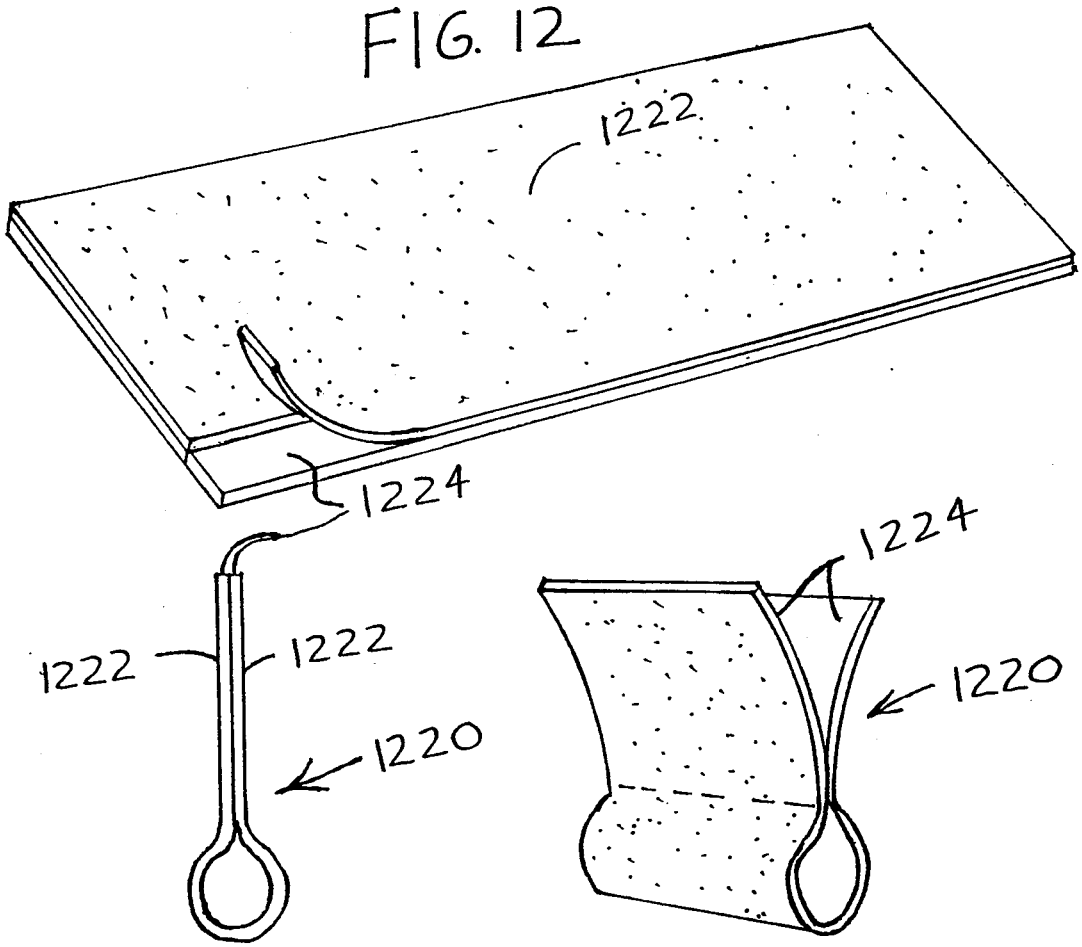
FIGS. 12–12b are a perspective view of a nonfolded sanding sheet with a corner pulled up to reveal the rubber backing material, the same sheet folded and stitched to form a loop, and the same sheet alternatively glued back to back to form a loop.

Sanding elements 1220 also take any of several forms, each suited to a specific type of job. As shown in FIGS. 10–10*b*, the individual sanding element 1220 may be a rectangular sheet of sand paper 1222 having optional rubber backing 1224. The sheet is then looped around and secured with stitches 1226, glue or other means to fit over an element rod 1204. See FIG. 12*a*. Alternatively, rubber backing 1224 may be glued back to back for added stiffness, as shown in FIG. 12*b*. The sheet 1222 may alternatively be cut to form strips 1230, as shown in FIGS. 13–13*b*. The stitching and gluing back-to-back alternatives are also contemplated as shown in FIGS. 13*a* and 13*b* respectively. Still another alternative is for fully separate strips 1234 to be cut, so that each strip 1234 can pivot independently on an element rod 1204. See FIGS. 14–14*b*. For this alternative, a cardboard or PVC buffer tube 1236 is preferably provided. Again, the stitching or gluing back-to-back options are available. Finally, sheets 1222 may be multilayered so that worn out sand paper strips 1230 can be torn off along a perforation 1242 to expose a fresh strip 1230 underneath. A single rubber backing 1224 for the entire stack of strips 1230 is optional. See FIGS. 15–15*a*.

Figure 16:
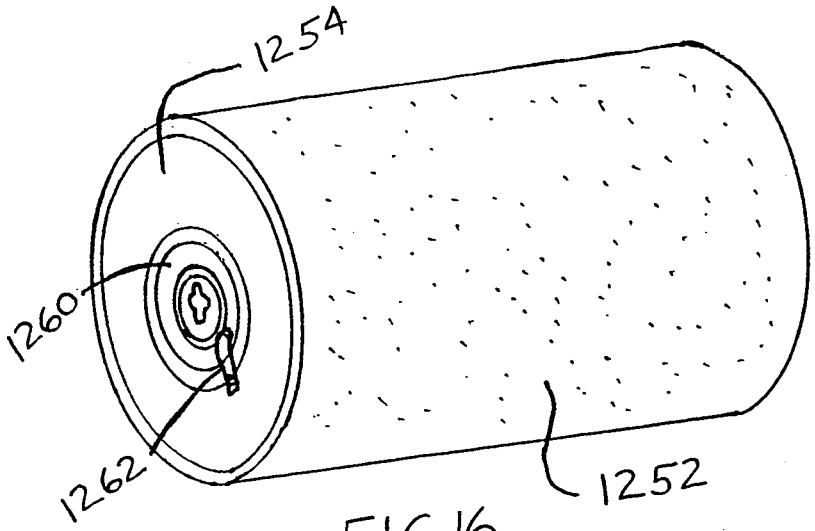
FIGS. 16–16b are a perspective view of the alternative sanding cylinder with an inflatable inner tube and sand paper on its outer surface, an exploded view of the inner tube, mounting hub and rod, and an exploded view of the sponge layer and sand paper tube, respectively.
Figure 16A:
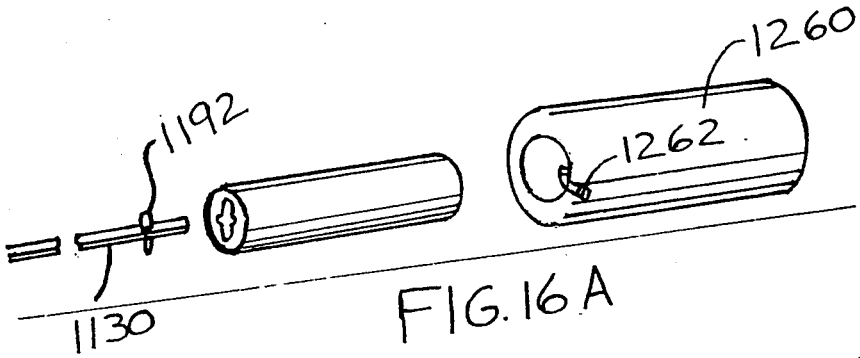
Figure 16B:
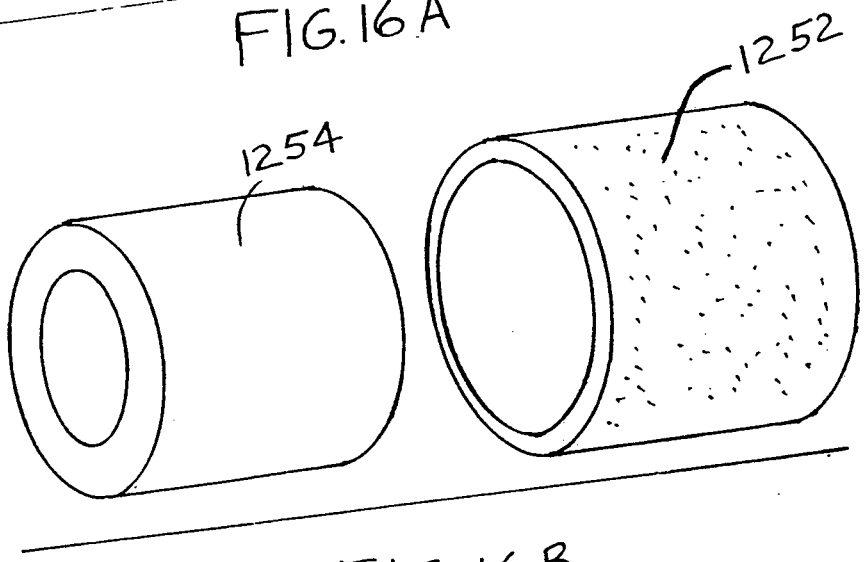

Apparatus 10 can function as a buffer. Assembly 1024 may be a tubular cylinder 1250 with a tube 1252 having a non-abrasive buffing surface or an abrasive sand paper surface, fitted around its outer wall. See FIGS. 16–16*b*. Cylinder 1250 is made of a sponge material 1254 fit over an inflatable tube 1260, with a valve stem 1262. Deflating tube 1260 permits the removal and replacement of spent sand paper tubes 1252.

Apparatus 10 can also function as a scraper. Cylinder 1250 may be a rigid metal pipe 1270 having raised V-shaped metal scraping elements 1272 to remove paint. See FIGS. 17–17*b*. The metal is preferably hardened steel or tungsten carbide. Apparatus 10 can also function as a grinder.

Figure 18:
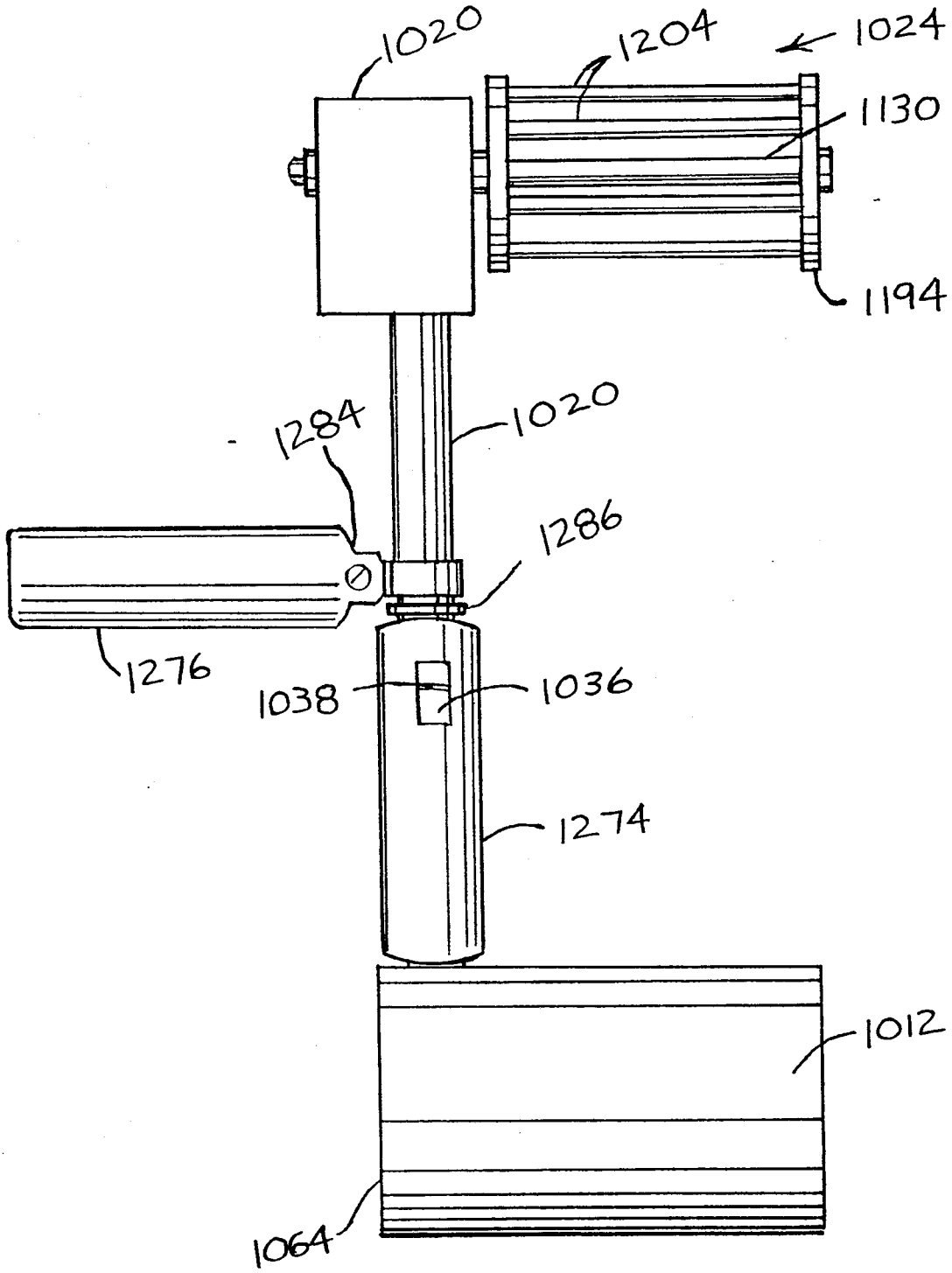
FIG. 18 is a front view of a variation of the inventive apparatus, having the handle moved to extend from the first support member and having no second support member, for sanding in corners.

Other variations of this embodiment of assembly 10 include those of FIGS. 18, 19, 20 and 21. FIG. 18 shows an apparatus 10 having only one support member 1020 with a rubber grip 1274 adjacent housing 1012, and having a handle 1276 projecting perpendicularly from member 1020. This variation permits the user to sand all the way into corners, without obstruction by member 1022. Handle 1276 optionally swivels at its attached end 1284. An additional swivel point 1286 is optional.

Figure 19:
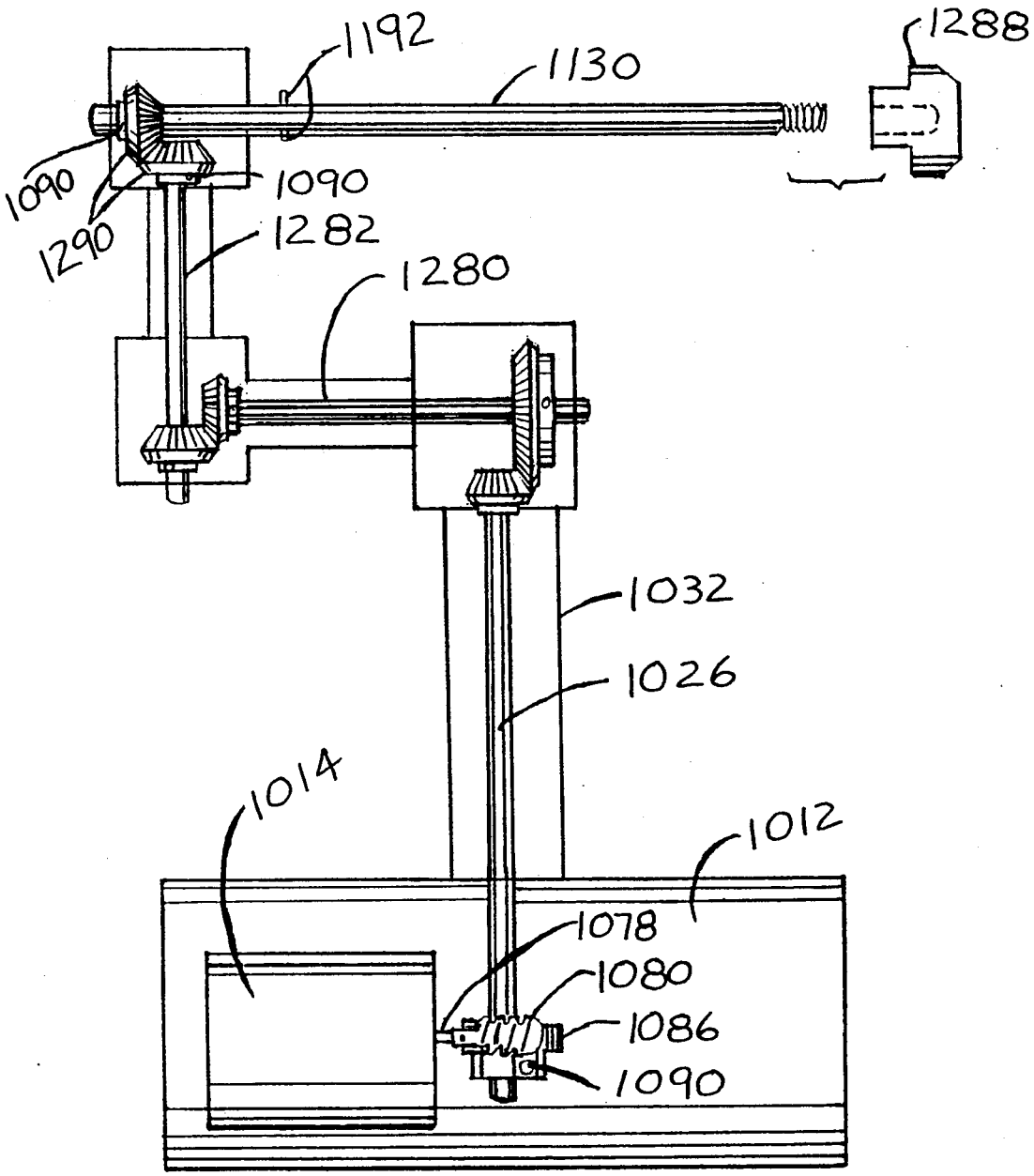
FIG. 19 is a front view of still another variation of the inventive apparatus, wherein the central handle member contains the drive train and the first and second support members are eliminated.

FIG. 19 shows still another variation of apparatus 10, wherein support members 1020 and 1022 are omitted and the drive shaft 1026 is contained within central handle member 1032. Torque is transmitted through shafts 1026, 1280 and 1282, and bevel gears 1290 to assembly shaft 1130. An end nut 1288 holds assembly 1024 on shaft 1130. This variation also permits sanding in corners.

Figure 20:
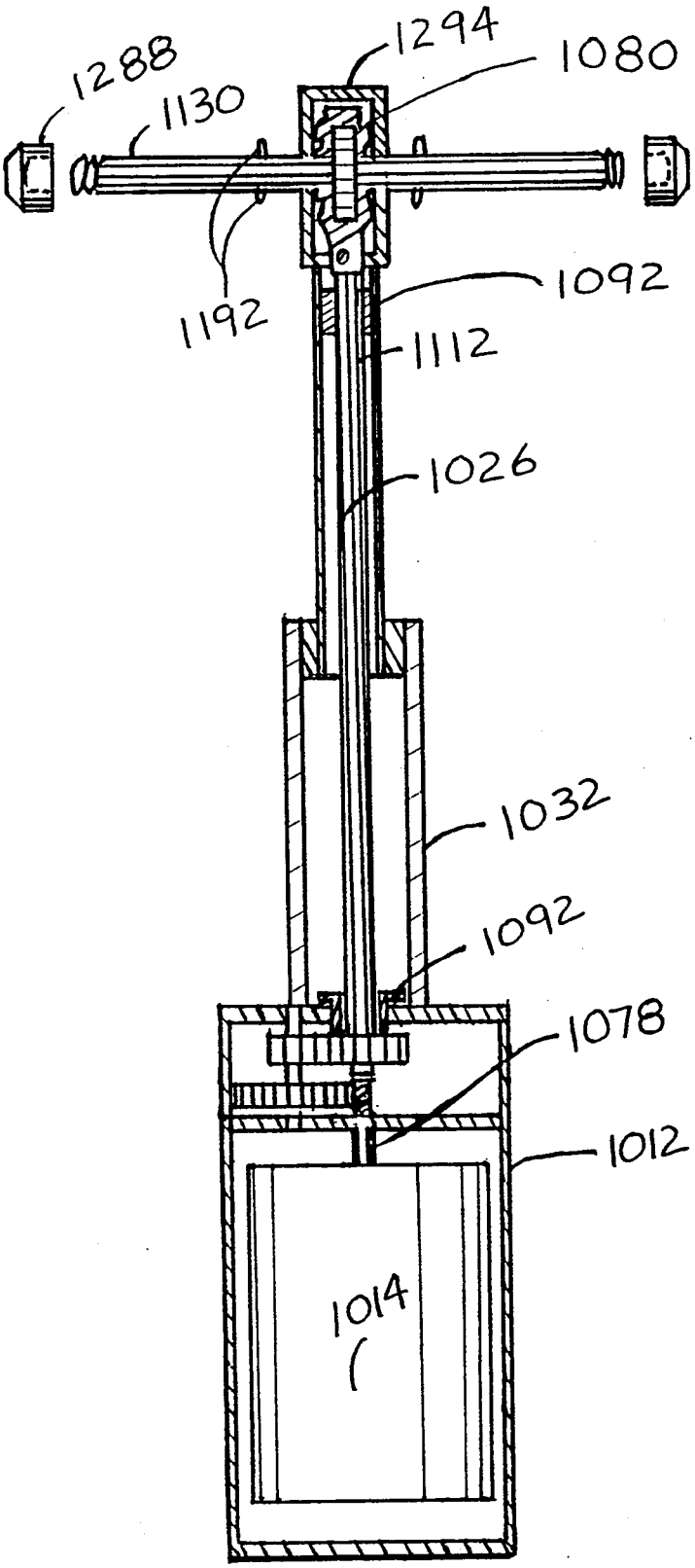
FIG. 20 is a front view of still another variation of the inventive apparatus, similar to that of FIG. 19, except that the motor is reoriented and the handle—support member divides the sanding element apparatus in two.

FIG. 20 illustrates how the motor 1014 can equivalently be oriented so that motor shaft 1078 is coaxial with drive shaft 1026. Assembly shaft 1130 projects from either side of a central mounting block 1294 so that a smaller assembly 1024 can be mounted on either side of block 1294.

Figure 21:
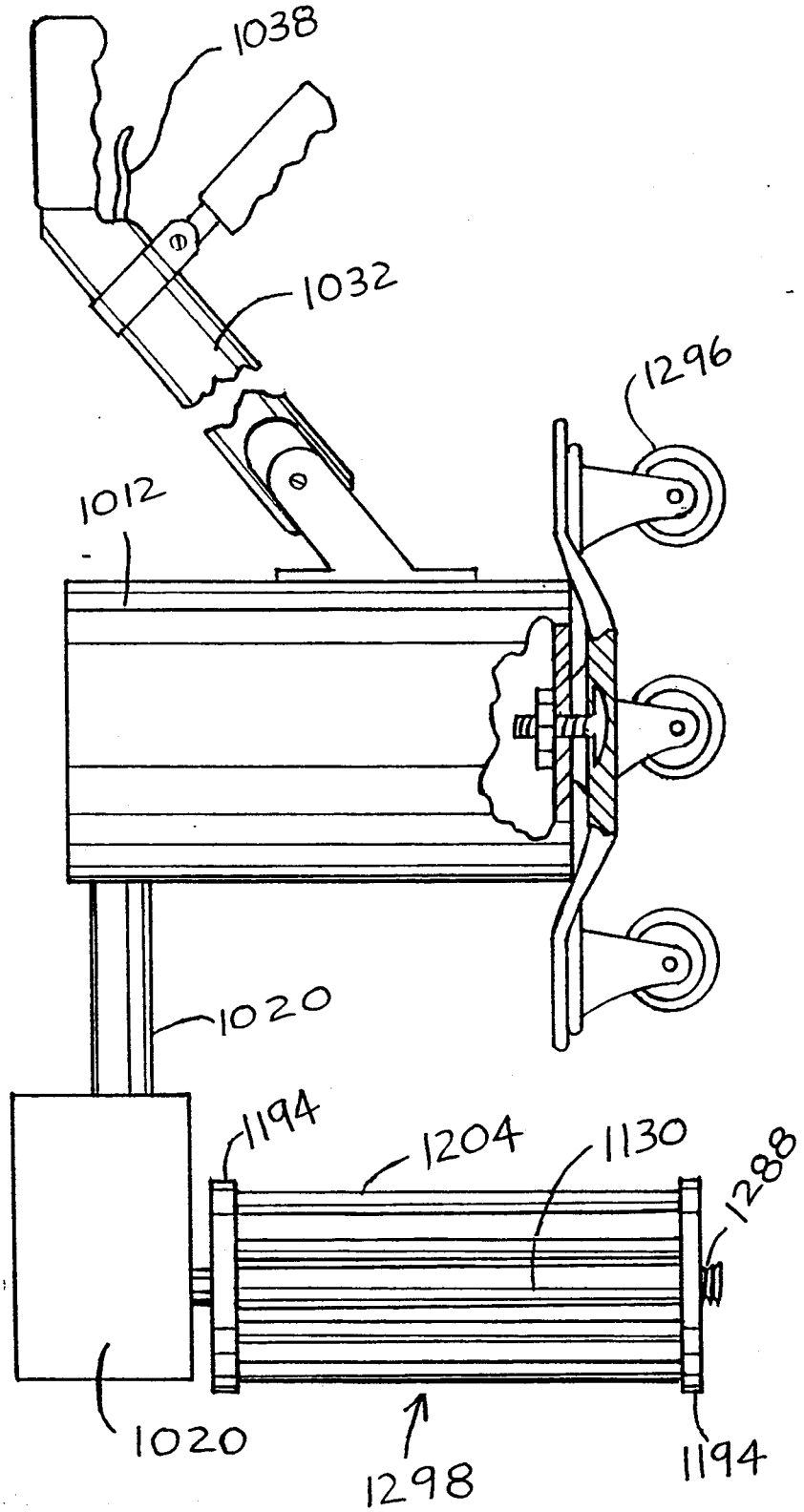
FIG. 21 is a front view of still another variation of in invention, for sanding baseboards, and provided with wheels and a vertical sanding element assembly. The spacer cylinder option is available on this variation as well, and on the variations referenced above.

FIG. 21 shows a variation of apparatus 10 for sanding baseboards. It has a handle 1032 with a trigger switch 1036, a motor 1014 mounted on wheels 1296 and a vertical holder 1298 for sanding elements 1220. It could also have an assembly 1024 with spacer cylinders 1210 for accommodating smaller sanding elements 1220.

Figure 22:
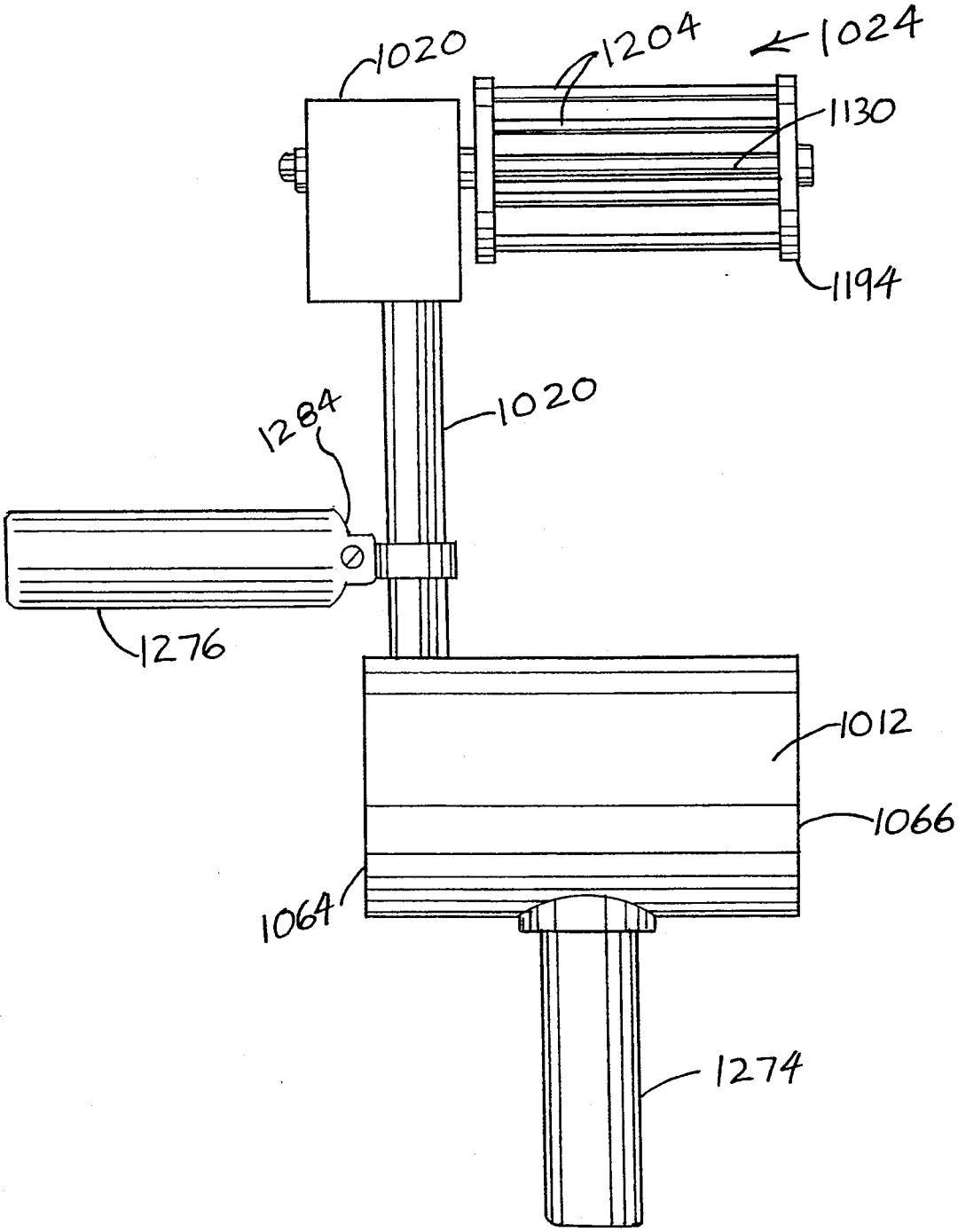
FIG. 22 is a front view of another variation of the invention, similar to that of FIG. 18, except that the rubber grip is located centrally below, rather than above, the cylindrical housing. This variation is convertible into a base board sanding model by just adding a handle and some wheels.

FIG. 22 shows a variation of the invention, similar to that of FIG. 18, except that the rubber grip is located centrally below, rather than above, the cylindrical housing. This variation is convertible into a base board sanding model by just adding a handle and some wheels.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for sanding a work piece, comprising:

a motor, a motor housing, an essentially cylindrical sanding element assembly comprising a sanding element, a tubular sanding element assembly first support member extending from said motor housing to said sanding element assembly, a drive train extending from said motor through said first support member to said sanding element assembly, wherein said motor housing is cylindrical and has a longitudinal axis, and said first support member extends essentially perpendicular to said housing longitudinal axis, and said cylindrical sanding element assembly also has a longitudinal axis which is essentially parallel to said housing longitudinal axis, and wherein said apparatus has a center of gravity located between said motor housing and said sanding element assembly, a tubular handle member attached to said housing essentially perpendicular to said longitudinal axis, and extending generally toward said sanding element assembly to permit gripping of said apparatus near said center of gravity of said apparatus, a switch contained within said handle member for controlling the flow of electric current through said motor.

2. An apparatus according to claim 1, additionally comprising:

a handle member attached to said first support member essentially perpendicular to said first support member.

3. An apparatus according to claim 1, wherein said sanding element assembly has an assembly shaft and wherein said housing has two ends, and wherein said first support member is joined to said housing midway between said two ends and to the middle of said assembly shaft, and wherein said sanding element assembly comprises first and second portions, one said portion being mounted on said assembly shaft on one side of said first support member and the other said portion being mounted on said assembly shaft on the other side of said first support member.

4. An apparatus for sanding a work piece, comprising:

a motor, a motor housing, an essentially cylindrical sanding element assembly comprising a sanding element, a tubular sanding element assembly first support member extending from said motor housing to said sanding element assembly, a drive train extending from said motor through said first support member to said sanding element assembly, wherein said motor housing is cylindrical and has a longitudinal axis, and said first support member extends essentially perpendicular to said housing longitudinal axis, and said cylindrical sanding element assembly also has a longitudinal axis which is essentially parallel to said housing longitudinal axis, wherein said sanding element assembly has two ends and wherein said housing has two ends, and wherein said first support member is joined to one said end of said housing and to one end of said sanding element assembly, a second support member joined to the end of said housing and extending to engage the other end of said sanding element assembly, a tubular handle member attached to said housing essentially perpendicular to said longitudinal axis, a switch contained within said handle member for controlling the flow of electric current through said motor, wherein said handle member has a free end, additionally comprising:

a protective shield attached to said free end of said handle member.

5. An apparatus for sanding a work piece, comprising:

a motor, a motor housing, an essentially cylindrical sanding element assembly comprising a sanding element, a tubular sanding element assembly first support member extending from said motor housing to said sanding element assembly, a drive train extending from said motor through said first support member to said sanding element assembly, a disk end member located at each end of said assembly, wherein each said disk end member has a central bore for receiving said assembly shaft, at least one sanding element mounting rod attached to and extending between said disk end members parallel to said assembly shaft, a sanding element comprising sand paper and having a looped portion to fit over said at least one sanding element mounting rod.

6. An apparatus according to claim 5, comprising a plurality of said sanding element mounting rods, located equidistant from said assembly shaft.

7. An apparatus according to claim 5, wherein said sanding element comprises:

a sheet of sand paper folded over form two flaps and a fold, and to expose its abrasive surface on two sides, wherein said two flaps are joined together a distance from said fold to create said loop between said fold and the joined areas of said two flaps.

8. An apparatus according to claim 7, comprising a plurality of said folded sheets positioned adjacent to each other on said at least one mounting rod.

9. An apparatus according to claim 7, additionally comprising:

durable backing material attached to said sheet opposite the sheet abrasive surface.

10. An apparatus according to claim 7, wherein said flaps are glued back-to-back for added stiffness.

11. An apparatus according to claim 7, wherein said flaps have free ends and are attached parallel to said fold such that said flaps can bend independently of each other from where they are stitched.

12. An apparatus according to claim 5, wherein said flaps are cut to form a plurality of individual strips extending perpendicularly in relation to said at least one mounting rod.

13. An apparatus according to claim 12, wherein said strips each comprise multiple layers of sand paper, such that, when the exposed layer becomes worn from use, it can be torn away to expose a fresh layer.

14. An apparatus according to claim 5, wherein at least one of said disk members is removable, so that said sanding elements can be slid off said at least one mounting rod and replaced.

15. An apparatus according to claim 5, wherein said sanding element functions as a scraper, and comprises:

a cylindrical drum having two ends and a wall outer surface, and having projecting ridges extending along said wall outer surface of said drum, for scraping paint off a work piece.

16. An apparatus according to claim 15, wherein said ridges are essentially V-shaped.

17. An apparatus according to claim 5, wherein said sanding element comprises:

a cylindrical drum having two ends and a wall outer surface, having a tubular piece of sand paper fitted around said wall outer surface with a sponge between said sand paper and said outer surface.

18. An apparatus according to claim 17, wherein said drum comprises inflatable means so that said drum can expand to grip said tubular piece of sand paper and contract to free said tubular piece of sand paper.

19. An apparatus according to claim 17, wherein said drum comprises inflatable means so that said drum can expand to grip said tubular piece of non-abrasive buffing material and contract to free said tubular piece of sand paper.

20. An apparatus according to claim 5, wherein said sanding element functions as a buffer, and comprises:

a cylindrical drum having two ends and a wall outer surface, having a tubular piece of non-abrasive buffing material fitted around said wall outer surface.

21. A sanding element assembly having two ends and comprising:

a disk end member located at each end of said assembly, wherein each said disk end member has a central bore for receiving a mounting shaft, at least one sanding element mounting rod attached to and extending between said disk end members parallel to said mounting shaft, a sanding element comprising sand paper and having a looped portion to fit over said at least one sanding element mounting rod.

* * * * *